US011462855B2

(12) United States Patent
Doll et al.

(10) Patent No.: US 11,462,855 B2
(45) Date of Patent: Oct. 4, 2022

(54) MAGNETIC-ENABLED QUICK DISCONNECT ELECTRICAL CONNECTOR

(71) Applicant: TE Connectivity Services GmbH, Schaffhausen (CH)

(72) Inventors: Kyle Michael Doll, Dillsburg, PA (US); Keith Edwin Miller, Manheim, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 90 days.

(21) Appl. No.: 17/005,754

(22) Filed: Aug. 28, 2020

(65) Prior Publication Data

US 2022/0069515 A1 Mar. 3, 2022

(51) Int. Cl.
*H01R 11/30* (2006.01)
*H01R 13/62* (2006.01)
*H01R 13/631* (2006.01)

(52) U.S. Cl.
CPC ..... *H01R 13/6205* (2013.01); *H01R 13/631* (2013.01)

(58) Field of Classification Search
CPC ..... H01R 13/6205; H01R 13/631; H01R 13/6315; H01R 13/5219; H01R 13/64; H01R 23/7073
USPC ..... 439/38, 39, 247–248, 271, 660, 680
See application file for complete search history.

(56) References Cited

U.S. PATENT DOCUMENTS 3,808,517 A * 4/1974 Fletcher ..... H03H 11/20 323/217
3,810,258 A * 5/1974 Mathauser ..... H01R 13/6205 439/39
6,558,180 B2 * 5/2003 Nishimoto ..... H01R 9/223 439/271
6,848,930 B2 * 2/2005 Fukuda ..... H01R 13/6277 439/271
7,329,128 B1 * 2/2008 Awad ..... H01R 13/6205 439/38
7,625,212 B2 * 12/2009 Du ..... H01R 13/6205 439/39
7,775,801 B2 * 8/2010 Shift ..... H01R 13/6205 439/39
9,011,176 B2 * 4/2015 Tziviskos ..... H05K 5/0247 439/607.4
10,135,179 B2 * 11/2018 Cooper ..... H01R 13/6276
10,148,035 B2 * 12/2018 Finona ..... H01R 13/6315
10,177,491 B2 * 1/2019 Davies ..... H01R 13/629
10,297,950 B2 * 5/2019 Wei ..... H01R 13/6205
10,374,353 B2 * 8/2019 Archuleta ..... F21V 21/096
10,559,917 B2 * 2/2020 Wang ..... H01R 13/6205
(Continued)

FOREIGN PATENT DOCUMENTS

WO 2013 / 076542 A1 5/2013

OTHER PUBLICATIONS

International Search Report, International Application No. PCT/IB2021/057532, International Filing Date, Aug. 28, 2021.

*Primary Examiner* — Thanh Tam T Le

(57) ABSTRACT

An electrical connector assembly for mating with a mating connector assembly. The connector assembly includes a housing having a first surface and a second surface. At least one magnet is provided the housing. A mating area extends from the first surface. The mating area has a sloped surface, which is sloped relative to a plane of the first surface of the housing.

13 Claims, 6 Drawing Sheets

(56) References Cited

U.S. PATENT DOCUMENTS

| | | | | |
|---|---|---|---|---|
| 10,651,594 | B1 | 5/2020 | Tsai et al. | |
| 10,658,789 | B1 * | 5/2020 | Wang | H01R 13/631 |
| 10,658,793 | B2 * | 5/2020 | Blake | H01R 13/64 |
| 2016/0211609 | A1 | 7/2016 | Sorias | |

* cited by examiner

MAGNETIC-ENABLED QUICK DISCONNECT ELECTRICAL CONNECTOR

FIELD OF THE INVENTION

The present invention is directed to a magnetic-enabled quick disconnect electrical connector. In particular, the invention is directed to an electrical connector which can easily breakaway from a mating connector from any direction.

BACKGROUND OF THE INVENTION

Connectors or connector assemblies are often mechanically secured to mating connectors, connector assemblies or panels to prevent the unwanted removal of the connector assembly from the mating connector assembly or panels. Mechanically secured connector assemblies typically employ push-pull, lever-actuated, partial-turn, or other manual locking mechanisms that are designed to release only with specific user intervention initiated directly at the connector interface and are otherwise engineered to hold tight—sometimes withstanding a pull force of dozens or even hundreds of pounds.

However, in many applications there is a need for connectors that are engineered to hold tight up to a predetermined point and then, when that force is reached, smoothly and cleanly let go. Breakaway connectors, which are also known as quick-release or quick-disconnect connectors, are often employed in applications including aviation and military helmets and headsets that attached to consoles or portable equipment with cables, mobile medical monitoring equipment attached to patients, and in other environments in order to prevent cord entanglement, snags, and pulls from hindering or harming the user and equipment they're attached to.

While various breakaway, quick-release or quick-disconnect connectors are currently available, such connectors are generally designed to release when an appropriate force is applied to the cable or connector in a direction which is in line with the longitudinal axis of the connector. However, such connectors fail to properly release if a force is applied to the cable or connector in a direction other than in line with the longitudinal axis of the connector, such as a force applied with a component which is perpendicular to in line with the longitudinal axis of the connector. The inability to release when such a force is applied can cause damage to the equipment and harm to the user.

It would be, therefore, beneficial to provide an electrical connector or connector assembly which can easily breakaway from a mating connector, connector assembly or panel upon the application of designated force, regardless of the direction the force is applied to the connector or connector assembly.

SUMMARY OF THE INVENTION

An embodiment is directed to an electrical connector assembly for mating with a mating connector assembly. The connector assembly includes a housing having a first surface and a second surface. At least one magnet is provided the housing. A mating area extends from the first surface. The mating area has a sloped surface, which is sloped relative to a plane of the first surface of the housing.

An embodiment is directed to an electrical connector assembly for mating with a mating connector assembly. The connector assembly includes a housing having a first surface and a second surface. At least one magnet is provided a magnet receiving cavity of the housing. A mating recess extends from the first surface in a direction toward the second surface. The mating recess has a sloped surface, which is sloped relative to a plane of the first surface of the housing. A resilient member is provided in the mating recess. The resilient member is configured to be resiliently deformable away from a longitudinal axis of the mating recess.

An embodiment is directed to a break away electrical connector assembly having a first connector assembly and a second connector assembly. The first connector assembly includes a first housing with a first magnet provided therein. The first connector assembly has a mating projection with a first sloped surface. The second connector assembly includes a second housing with a second magnet provided therein. The second magnet is configured to provide an attractive force with the first magnet when the first connector assembly and the second connector assembly are mated. The second connector assembly has a mating recess with a second sloped surface. The second sloped surface is configured to cooperate with the first sloped surface.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
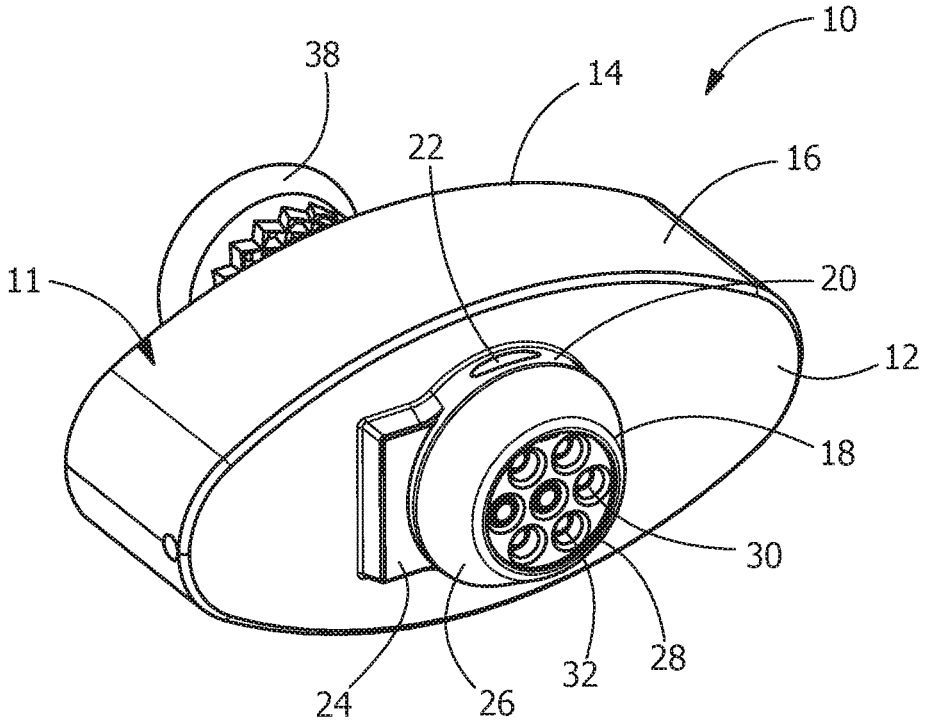
FIG. 1 is a front perspective view of an illustrative embodiment of an electrical connector assembly of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
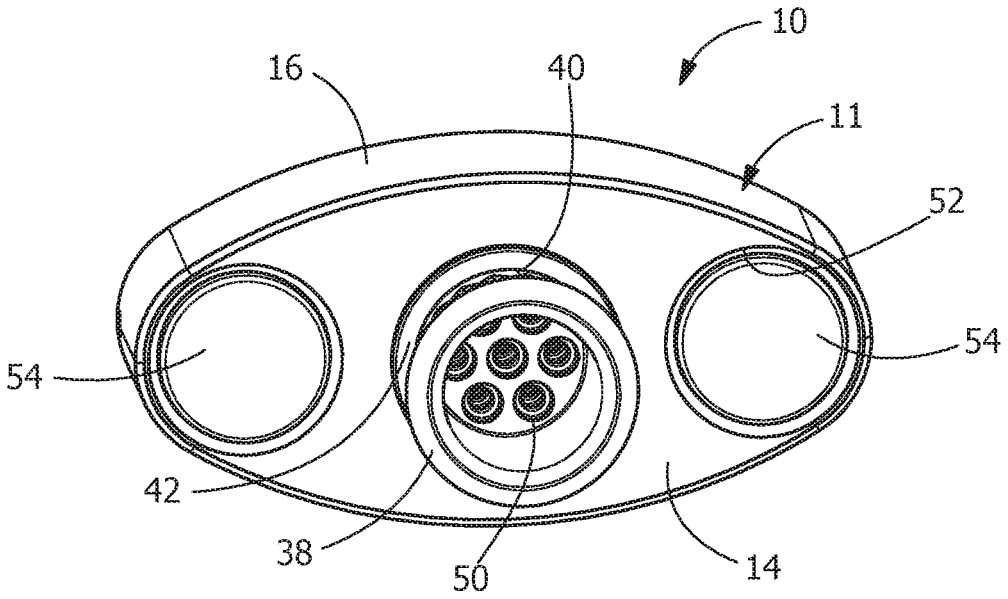
FIG. 2 is a back perspective view of the electrical connector assembly of FIG. 1.

As shown in FIGS. 1 and 2, an electrical connector assembly 10 has a housing 11 with a first surface 12 and an oppositely facing second surface 14. Sidewalls 16 extend between the first surface 12 and the second surface 14. In the illustrative embodiment shown, the first surface 12 and the second surface 14 have an oval configuration. However, the first surface 12 and the second surface 14 may have other configurations without departing from the scope of the invention.

As shown in FIG. 1, a mating projection 18 extends from the first surface 12 in a direction away from the second surface 14. The mating projection 18 has a sidewall 20 which extends in a direction which is essentially perpendicular to the plane of the first surface 12. The sidewall 20 has one or more securing recesses 22 provided therein. A keying member 24 extends from a portion of the sidewall 20. The keying member 24 also extends from the first surface 12.

An angled or sloped surface or wall 26 extends from the sidewall 20 in a direction away from the first surface 12. The angled or sloped wall 26 extends from the sidewall 20 to a mating face 28. The mating face 28 has contacts 30 provided thereon or extending therethrough. In the embodiment shown, the contacts 30 are target contacts with concave interfaces 32. The angled or sloped wall 26 is angled relative to the first surface 12 and the mating face 28. While the angle may vary depending upon the length of the mating projection 18, the angled or sloped wall 26 is angled approximate 25 to 50 degrees relative to the mating face 28 in the illustrative embodiment shown.

In the illustrative embodiment shown, cross-sections of the mating projection 18 have a generally circular configuration. However, other configurations of the mating projection 18 may be used.

As shown in FIG. 2, a cable or component receiving projection 38 extends from the second surface 14 in a direction away from the first surface 12. The component receiving projection 38 has a sidewall 40 which extends in a direction which is essentially perpendicular to the plane of the second surface 14. The sidewall 40 has one or more securing shoulders 42 provided therein. A wire receiving face 48 is provided in the component receiving projection 38.

In the illustrative embodiment shown, cross-sections of the cable or component receiving projection 38 have a generally circular configuration. However, other configurations of the cable or component receiving projection 38 may be used.

Magnet receiving cavities 52 extend in the housing 11 from the second surface 14 toward the first surface 12. Caps 54 are positioned in the magnet receiving cavities 52. The caps 54 may be made from various materials, including, but not limited to, rubber. Alternative methods of retaining the magnets in the shell may be used, such as, but not limited to, epoxy or crimping/deforming of the shell after the magnets are properly positioned.

Figure 6:
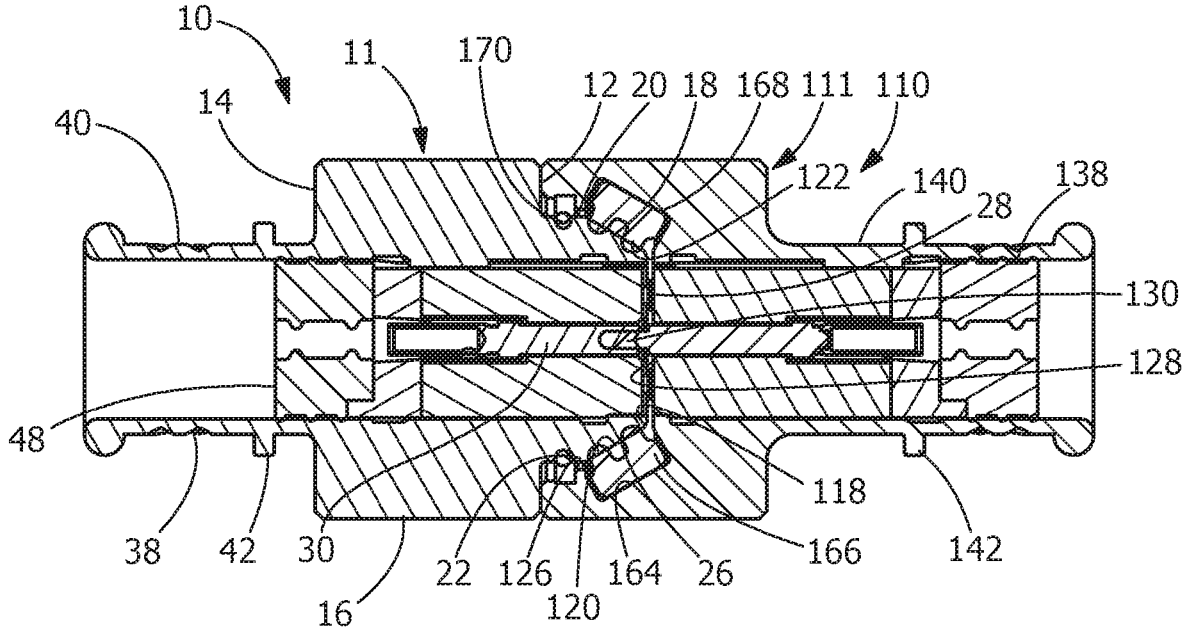
FIG. 6 is a cross-sectional view taken along line 6-6 of FIG. 5.

Referring to FIG. 6, magnets 56 are positioned in the magnet receiving cavities 52 and are retained in the magnet receiving cavities 52 by the caps 54. The caps 54 have projections or a collar 58 which extend from sidewalls 60 of the caps 54. The projections or a collar 58 are positioned in retention recesses 62 of the magnet receiving cavities 52 when the caps 54 are fully inserted into the magnet receiving cavities 52. The cooperation of the projections or a collar 58 and the retention recesses 62 prevents the unwanted removal of the caps 54 and the magnets 56 from the magnet receiving cavities 52.

Figure 3:
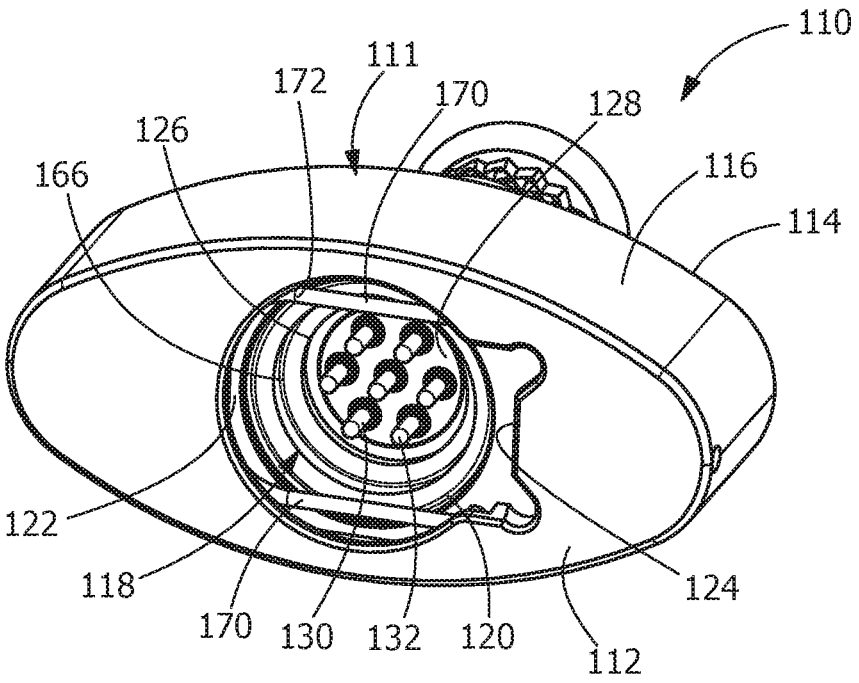
FIG. 3 is a front perspective view of an illustrative embodiment of a mating electrical connector assembly of the present invention.
Figure 4:
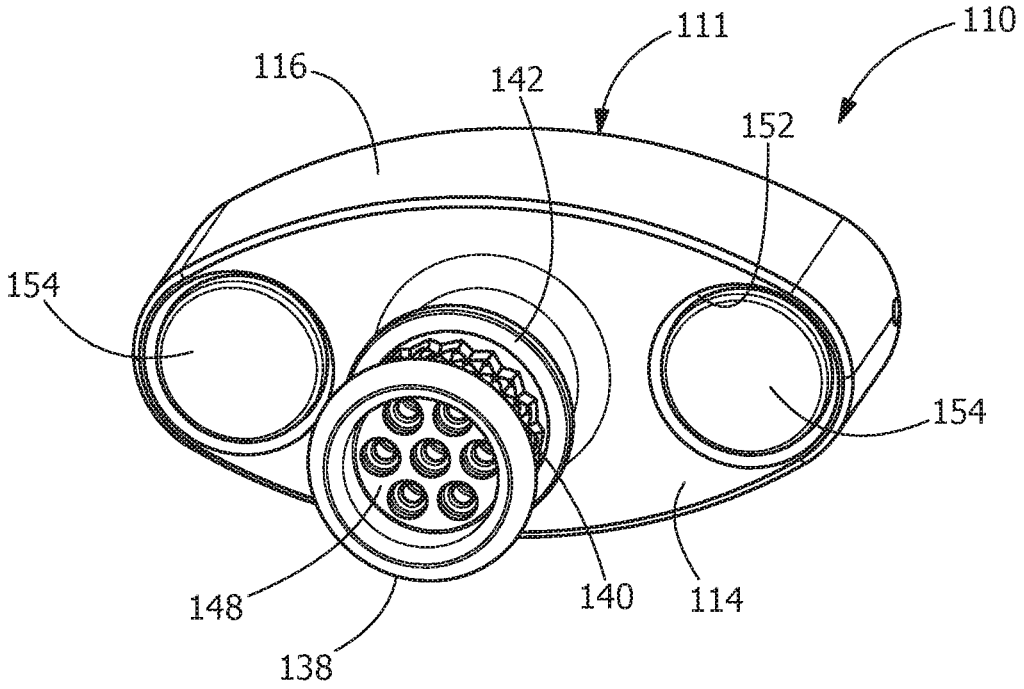
FIG. 4 is a back perspective view of the mating electrical connector assembly of FIG. 3.

As shown in FIGS. 3 and 4, a mating electrical connector assembly 110 has a housing 111 with a first surface 112 and an oppositely facing second surface 114. Sidewalls 116 extend between the first surface 112 and the second surface 114. In the illustrative embodiment shown, the first surface 112 and the second surface 114 have an oval configuration. However, the first surface 112 and the second surface 114 may have other configurations without departing from the scope of the invention.

As shown in FIG. 3, a mating recess 118 extends from the first surface 112 in a direction toward the second surface 114. The mating recess 118 has a sidewall 120 which has a receiving portion 122 which extends in a direction which is essentially perpendicular to the plane of the first surface 112. A keying recess 124 extends from the sidewall 120. The keying recess 124 also extends from the first surface 112. The keying recess 124 is configured to allow the keying member 24 to be inserted therein.

An angled or sloped surface or portion 126 of the sidewall 120 extends from the receiving portion 122 in a direction away from the first surface 112. The angled or sloped portion 126 extends from the receiving portion 122 to a mating face 128. The angled or sloped portion 126 is angled relative to the first surface 112 and the mating face 128. While the angle may vary depending upon the depth of the mating recess 118, the angled or sloped portion 126 is angled approximate 25 to 50 degrees relative to the mating face 128 in the illustrative embodiment shown. The angle of the angled or sloped portion 126 is configured to be approximately equal to the angle of the angled or sloped wall 26 of the mating projection 18 of the connector assembly 10.

The mating face 128 has contacts 130 provided thereon or extending therethrough. In the embodiment shown, the contacts 130 are spring probes or resilient pins with concave interfaces 132 at a free end thereof.

In the illustrative embodiment shown, cross-sections of the mating recess 118 have a generally circular configuration. However, other configurations of the mating recess 118 may be used.

Figure 7:
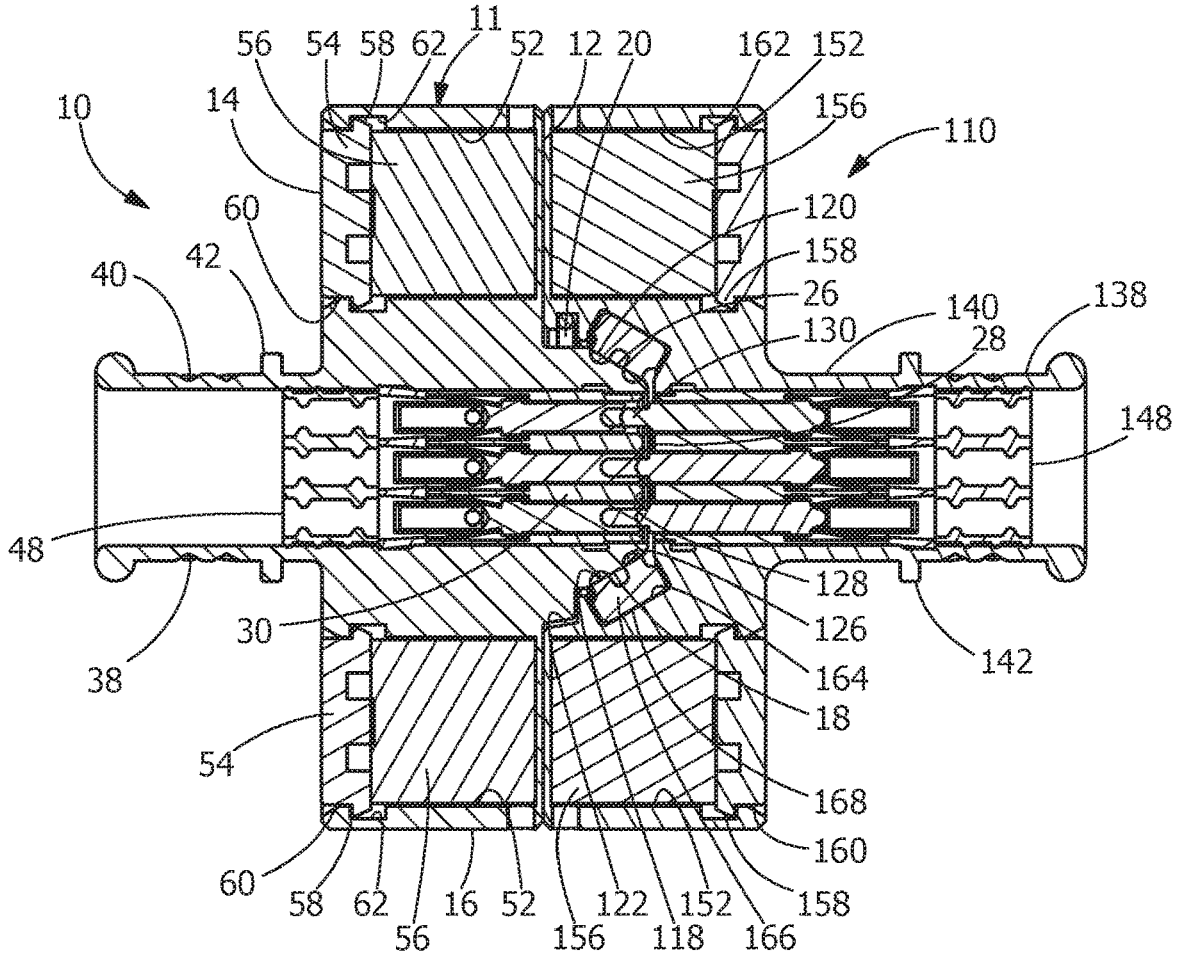
FIG. 7 is a cross-sectional view taken along line 7-7 of FIG. 5.

As shown in FIGS. 3, 6 and 7, the angled or sloped portion 126 has a circumferential seal receiving recess 164. A seal 166 is positioned in the seal receiving recess 164. A back wall 168 of the seal receiving recess 164 is angled at approximately the same angle as the angled or sloped portion 126 is angled relative to the mating face 128.

Legs 170 of a resilient securing member 172 are provided in the mating recess 118. The legs 170 are a portion of a U-shaped resilient securing member 172. The legs 170 are resiliently deformable away from a longitudinal axis of the mating recess 118 as the mating projection 18 of connector assembly 10 is positioned in the mating recess 118 of mating connector assembly 110, as will be more fully described.

As shown in FIG. 4, a cable or component receiving projection 138 extends from the second surface 114 in a direction away from the first surface 112. The component receiving projection 138 has a sidewall 140 which extends in a direction which is essentially perpendicular to the plane of the second surface 114. The sidewall 140 has one or more securing shoulders 142 provided therein. A wire receiving face 148 is provided in the component receiving projection 138.

In the illustrative embodiment shown, cross-sections of the cable or component receiving projection 138 have a generally circular configuration. However, other configurations of the cable or component receiving projection 138 may be used.

Magnet receiving cavities 152 extend in the housing 111 from the second surface 114 toward the first surface 112. Caps 154 are positioned in the magnet receiving cavities 152. The caps 154 may be made from various materials, including, but not limited to, rubber.

Referring to FIG. 7, magnets 156 are positioned in the magnet receiving cavities 152 and are retained in the magnet receiving cavities 152 by the caps 154. The caps 154 have projections or a collar 158 which extend from sidewalls 160 of the caps 154. The projections or a collar 158 are positioned in retention recesses 162 of the magnet receiving cavities 152 when the caps 154 are fully inserted into the magnet receiving cavities 152. The cooperation of the projections or a collar 158 and the retention recesses 162 prevents the unwanted removal of the caps 154 and the magnets 156 from the magnet receiving cavities 152.

Figure 5:
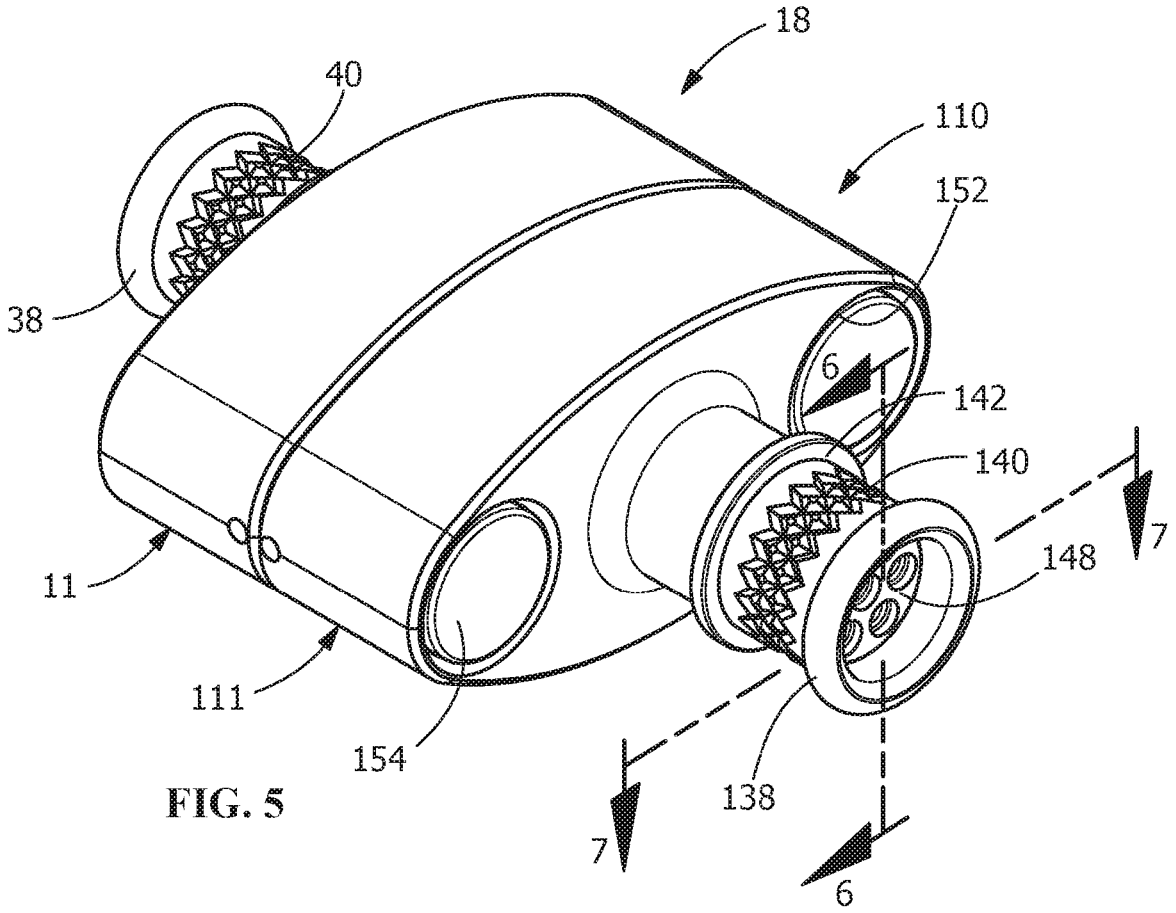
FIG. 5 is a perspective view of the electrical connector of FIG. 1 mated to the mating electrical connector of FIG. 3.

In use, the cable or component receiving projection 138 of the mating connector assembly 110 is mounted or secured to a cable or device (not shown). The cable or component receiving projection 38 of the connector assembly 10 is mounted or secured to a cable or device (not shown). When desired, the connector assembly 10 and mating connector assembly 110 are mated together to form a mechanical and electrical connection therebetween, as shown in FIGS. 5, 6 and 7.

As mating occurs, the magnets 56 and magnets 156 are configured to exert an attractive force between the magnets 56 an the magnets 156. In the illustrative embodiment shown, the magnets 56, 156 are polarized magnets to allow mating of the connector assembly 10 and mating connector assembly 110 without the user needing to line up the keying member 24 to the keying recess. The magnets are powerful enough that if the connector assembly 10 and mating connector assembly 110 are placed in proximity to each other they get properly oriented to each other by themselves.

In order to maintain the proper orientation of the connector assembly 10 to the mating connector assembly 110 as insertion occurs and after mating, the keying member 24 is positioned in the keying recess 124 to prevent the rotation of the connector assembly 10 to the mating connector assembly 110. In addition, the alignment of the keying member 24 and the keying recess 124 can facilitate the mechanical polarization of the connector assembly 10 and the mating connector assembly 110.

As insertion continues, the angled or sloped wall 24 of the connector assembly 10 engages the seal 166 positioned in the angled or sloped portion 124 of the mating connector assembly 110. The legs 170 of the resilient securing member 172 are moved outward as the mating projection 18 is inserted into the mating recess 118.

With the mating projection 18 fully inserted into the mating recess 118, the legs 170 enter the securing recess 22 positioned in the sidewall 20 of the mating projection 18 of the connector assembly 10. As this occurs, the legs 170 move back toward their unstressed position, thereby exerting a retention force on the securing recess 22 and the mating projection 18 to retain the mating projection 18 in the mating recess 118, allowing the contacts 30 and contacts 130 to be retained in mechanical and electrical engagement.

The magnetic attraction or force of the connector assembly 10 coupled to the mating connector assembly 110 can be configured for a particular implementation and a particular force as desired. In various embodiments, the magnet attraction is configured to be small, in the range of, but not limited to, between 1-5 lbs., to allow the connector assembly 10 to be easily removed from the mating connector assembly 110 when a force is applied to either the connector assembly 10 or the mating connector assembly 110. In other embodiments, the magnet attraction is configured to be large, in the range of, but not limited to, between 5-15 lbs., to prevent the connector assembly 10 from being easily removed from the mating connector assembly 110 when a force is applied to either the connector assembly 10 or the mating connector assembly 110. The magnetic field produced by the magnetic attraction between the magnets 56 and the magnets 156 is controlled to prevent the magnetic field from interfering with the signal transmission between the connector assembly 10 and the mating connector assembly 110.

Similarly, the legs 170 of the resilient securing member 172 can be configured to allow the retention force to be configured for a particular implementation and a particular force as desired. In various embodiments, the retention force is configured to be small, in the range of between 1-5 lbs. to allow the connector assembly 10 to be easily removed from the mating connector assembly 110 when a force is applied to either the connector assembly 10 or the mating connector assembly 110. In other embodiments, the retention force is configured to be large, in the range of between 5-15 lbs., to prevent the connector assembly 10 from being easily removed from the mating connector assembly 110 when a force is applied to either the connector assembly 10 or the mating connector assembly 110.

Figure 8:
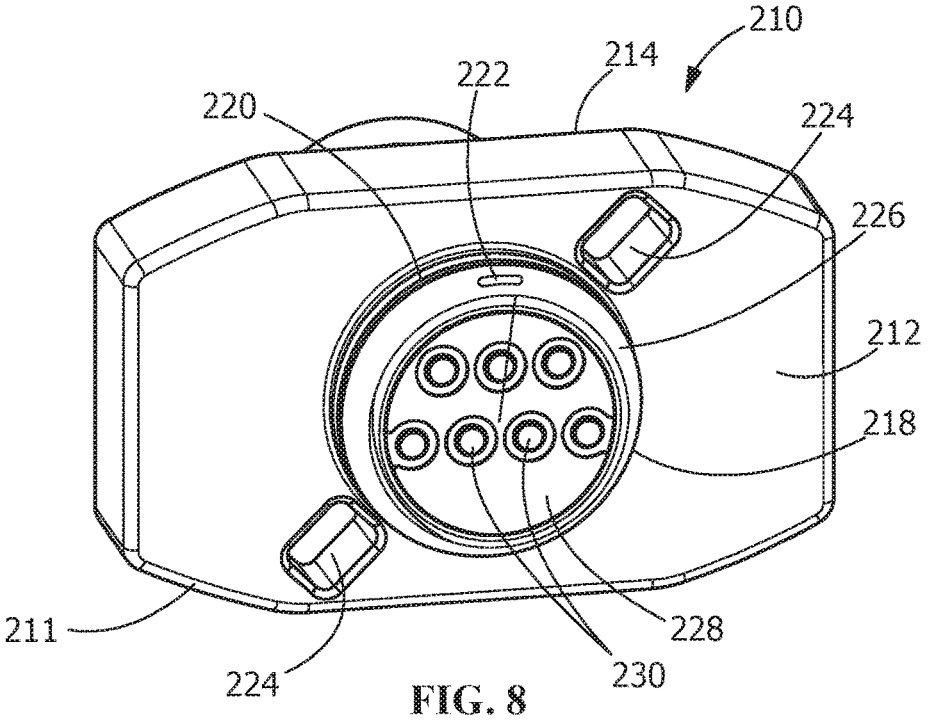
FIG. 8 is a front perspective view of an alternate illustrative embodiment of an electrical connector assembly of the present invention.
Figure 10:
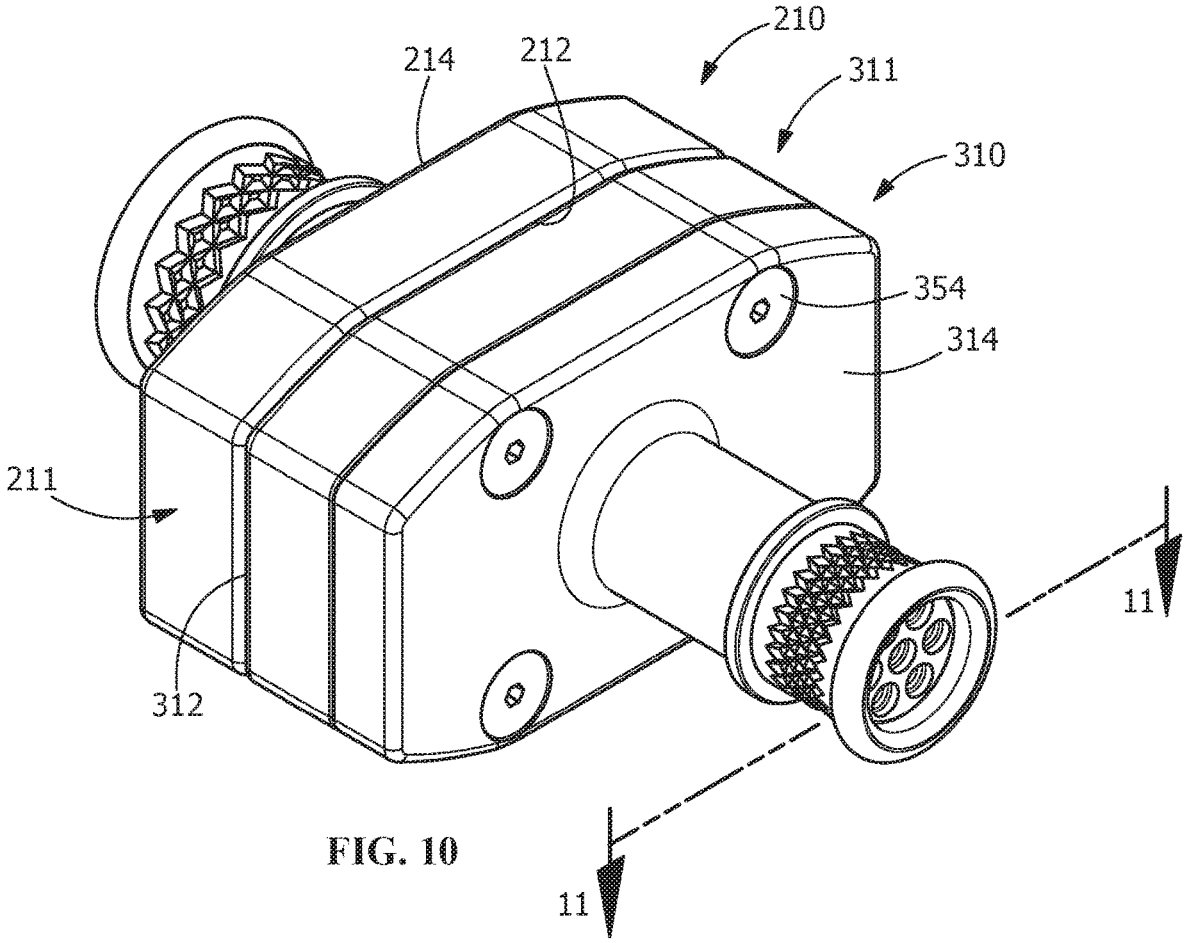
FIG. 10 is a perspective view of the electrical connector of FIG. 8 mated to the mating electrical connector of FIG. 9.
Figure 11:
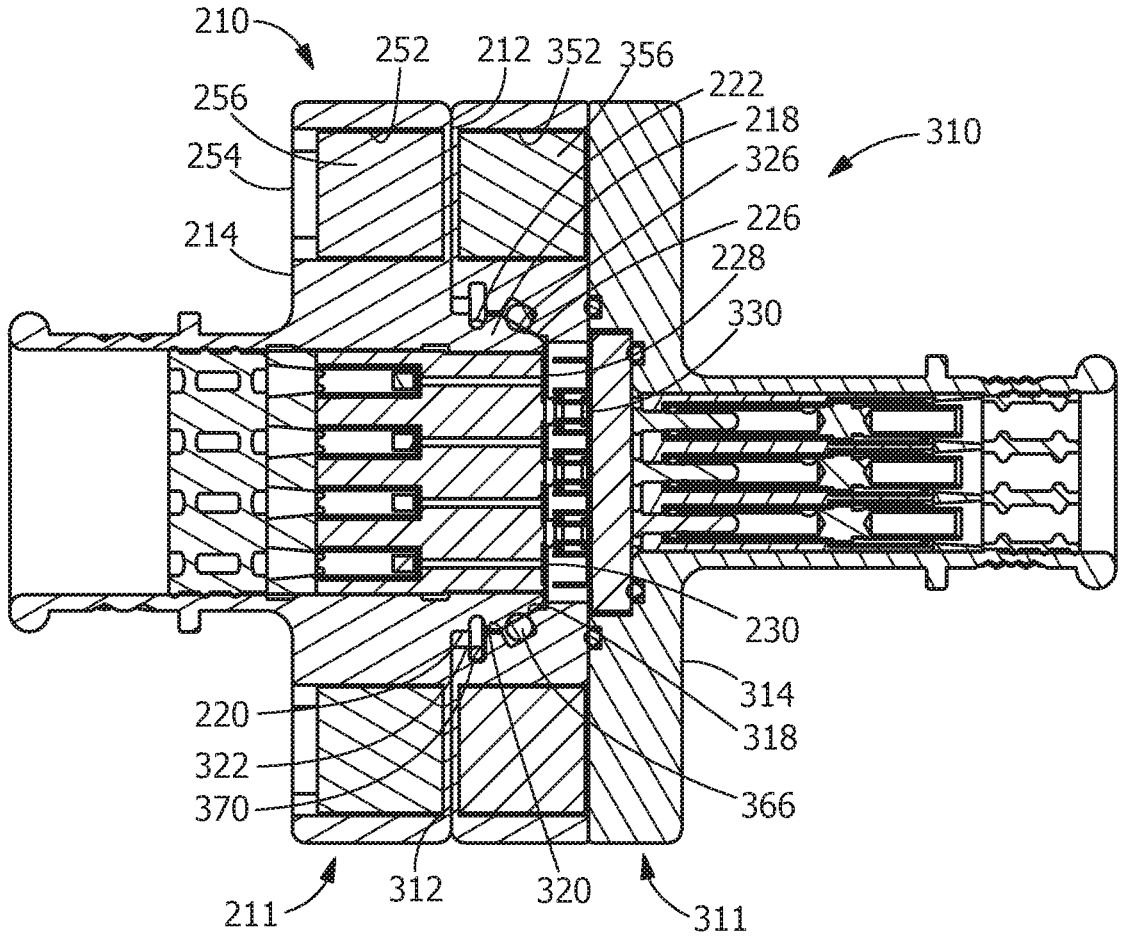
FIG. 11 is a cross-sectional view taken along line 11-11 of FIG. 10.

As shown in FIGS. 8, 10 and 11, an alternate electrical connector assembly 210 has a first surface 212 and an oppositely facing second surface 214. As many of the components of connector assembly 210 are identical to the connector assembly 10, those components are incorporated by reference.

A mating projection 218 extends from the first surface 212 in a direction away from the second surface 214. The mating projection 218 has a sidewall 220 which extends in a direction which is essentially perpendicular to the plane of the first surface 212. The sidewall 220 has one or more securing recesses 222 provided therein. Keying openings 224 extend from the first surface 212 toward the second surface 214.

An angled or sloped wall 226 extends from the sidewall 220 in a direction away from the first surface 212. The angled or sloped wall 226 extends from the sidewall 220 to a mating face 228. The mating face 228 has contacts 230 provided thereon or extending therethrough. In the embodiment shown, the contacts 30 are surface mounted contacts. The angled or sloped wall 226 is angled relative to the first surface 212 and the mating face 228. While the angle may vary depending upon the length of the mating projection 218, the angled or sloped wall 226 is angled approximate 25 to 50 degrees relative to the mating face 228 in the illustrative embodiment shown.

Magnet receiving cavities 252 extend in the housing 211 from the second surface 214 toward the first surface 212. Caps 254 are positioned in the magnet receiving cavities 252. Referring to FIG. 11, magnets 256 are positioned in the magnet receiving cavities 252 and are retained in the magnet receiving cavities 252 by the caps 254.

Figure 9:
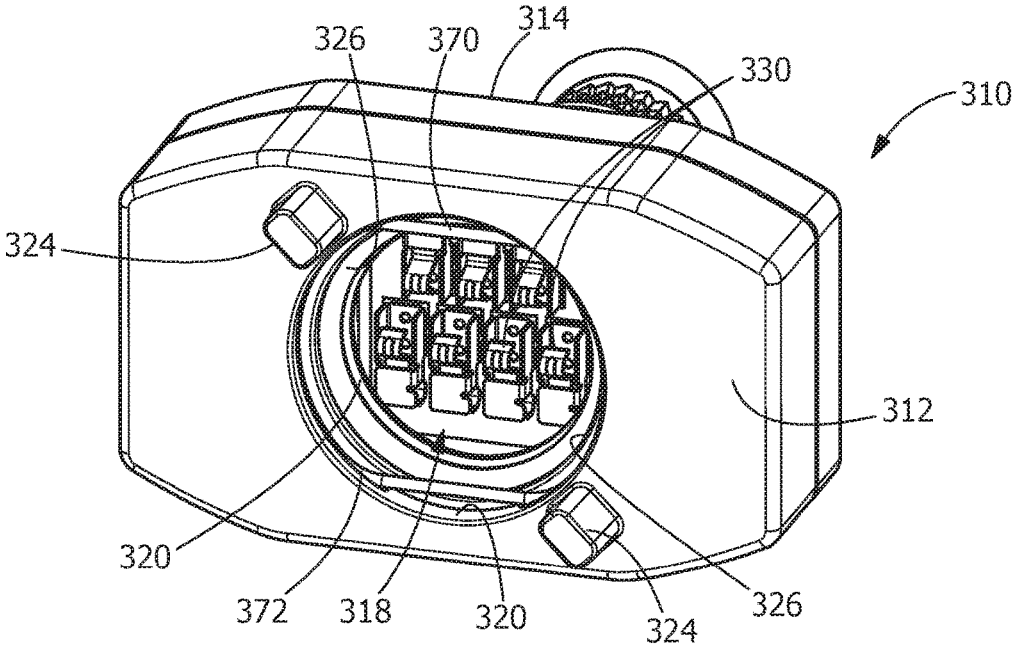
FIG. 9 is a front perspective view of an alternate illustrative embodiment of a mating electrical connector assembly of the present invention.

As shown in FIGS. 9, 10 and 11, a mating electrical connector assembly 310 has a first surface 312 and an oppositely facing second surface 314. As many of the components of connector assembly 310 are identical to the connector assembly 110, those components are incorporated by reference.

A mating recess 318 extends from the first surface 312 in a direction toward the second surface 314. The mating recess 318 has a sidewall 320 which has a receiving portion 322 which extends in a direction which is essentially perpendicular to the plane of the first surface 112. Keying projections 324 extends from the first surface 312. The keying projections 324 are configured to be positioned in the keying openings 224.

An angled or sloped portion 326 of the sidewall 320 extends from the receiving portion 322 in a direction away from the first surface 312. The angled or sloped portion 326 extends from the receiving portion 322 to a mating face 328. The angled or sloped portion 326 is angled relative to the first surface 312 and the mating face 328. While the angle may vary depending upon the depth of the mating recess 318, the angled or sloped portion 326 is angled approximate 25 to 50 degrees relative to the mating face 328 in the illustrative embodiment shown. The angle of the angled or sloped portion 326 is configured to be approximately equal to the angle of the angled or sloped wall 226 of the mating projection 218 of the connector assembly 210.

The mating face 328 has contacts 330 provided thereon or extending therethrough. In the embodiment shown, the contacts 330 are surface mounted contacts.

The angled or sloped portion 326 has a circumferential seal receiving recess 364. An O-ring seal 366 is positioned in the seal receiving recess 364.

Legs 370 of a resilient securing member 372 are provided in the mating recess 318. The legs 370 are a portion of a U-shaped resilient securing member 372. The legs 370 are resiliently deformable away from a longitudinal axis of the mating recess 318 as the mating projection 218 of connector assembly 210 is positioned in the mating recess 318 of mating connector assembly 310.

Magnet receiving cavities 352 extend in the housing 311 from the second surface 314 toward the first surface 312. In this illustrative embodiment, the housing 311 has two pieces which form the magnet receiving cavities 152 and retain the magnets 356 in the magnet receiving cavities 152.

The use and operation of the connector assembly 210 and mating connector assembly 310 are similar to that previously described with respect to connector assembly 10 and mating connector assembly 110.

In various environments, it is important that the connector assembly 10, 210 be allowed to be removed or break away from the mating connector assembly 110, 310 when a designated amount of force is applied from any direction to the connector assembly 10, 210 or the mating connector assembly 110, 310. To allow the connector assembly 10, 210 and mating connector assembly 110, 310 to be properly released in different directions, the magnetic attraction or force of the magnets 56, 256 and 156, 356, the retention force of the securing member 172, 272, and the angles of the angled or sloped wall 26, 226 and the angled or sloped portion 126, 326 must be controlled.

Accordingly, the electrical connector or connector assembly, as described herein, can easily breakaway from the mating connector, connector assembly or panel, as described herein, upon the application of designated force, regardless of the direction the force is applied to the connector or connector assembly. The ability to release in different directions allows the connector assembly to be used in many applications or environments to prevent damage to the equipment and prevent harm to the user.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector assembly for mating with a mating connector assembly, the connector assembly comprising:

a housing having a first surface and a second surface;

at least one magnet provided in the housing;

a mating recess extending from the first surface, the mating recess having a sloped surface, which is sloped relative to a plane of the first surface of the housing;

legs of a resilient securing member extend into the mating recess, the legs are resiliently deformable away from a longitudinal axis of the mating recess as the mating connector assembly is positioned in the mating recess;

wherein the resilient securing member is configured to apply a retention force to retain the mating connector assembly in the mating recess, the retention force is approximately 15 lbs or less.

2. The electrical connector assembly as recited in claim 1, wherein the at least one magnet is a polarized magnet provided in a magnet receiving cavity which extends from the second surface of the housing toward the first surface.

3. The electrical connector assembly as recited in claim 2, wherein a cap is provided at the end of the magnet receiving cavity to maintain the magnet in the magnet receiving cavity.

4. The electrical connector assembly as recited in claim 1, wherein the mating recess which extends from the first surface of the housing in a direction toward the second surface.

5. The electrical connector assembly as recited in claim 4, wherein the mating recess has a sidewall with a receiving portion which extends in a direction which is essentially perpendicular to the plane of the first surface.

6. The electrical connector assembly as recited in claim 5, wherein the sloped surface extends from the receiving portion in a direction away from the first surface, the sloped surface extends from the receiving portion to a mating face, the slope surface is angled relative to the first surface and the mating face, the mating face having contact provided thereon or extending therethrough.

7. The electrical connector assembly as recited in claim 5, wherein a keying member is provided on the housing.

8. The electrical connector assembly as recited in claim 5, wherein sloped surface has a circumferential seal receiving recess, a seal is positioned in the seal receiving recess.

9. An electrical connector assembly for mating with a mating connector assembly, the connector assembly comprising:

a housing having a first surface and a second surface;

at least one polarized magnet provided in a magnet receiving cavity of the housing;

a mating recess extending from the first surface in a direction toward the second surface, the mating recess having a sloped surface, which is sloped relative to a plane of the first surface of the housing;

a resilient member provided in the mating recess, the resilient member configured to be resiliently deformable away from a longitudinal axis of the mating recess;

wherein the resilient securing member is configured to apply a retention force to retain the mating connector assembly in the mating recess, the retention force is approximately 15 lbs or less;

wherein the electrical connector assembly can break away from the mating connector assembly upon the application of a designated force, regardless of the direction the force is applied to the electrical connector assembly.

10. The electrical connector assembly as recited in claim 9, wherein the sloped surface extends from the proximate the first surface to a mating face, the slope surface is angled relative to the first surface and the mating face, the mating face having contact provided thereon or extending therethrough.

11. The electrical connector assembly as recited in claim 10, wherein a keying member is provided on the housing.

12. The electrical connector assembly as recited in claim 10, wherein sloped surface has a circumferential seal receiving recess, a seal is positioned in the seal receiving recess.

13. A break away electrical connector assembly comprising:

a first connector assembly comprising:

a first housing having a first polarized magnet provided therein;

a mating projection having a first sloped surface;

a second connector assembly comprising:

a second housing having a second polarized magnet provided therein, the second magnet configured to provide an attractive force with the first magnet when the first connector assembly and the second connector assembly are mated;

a mating recess having a second sloped surface, the second sloped surface configured to cooperate with the first sloped surface;

a resilient member provided in the mating recess of the second connector assembly, the resilient member configured to be resiliently deformable away from a longitudinal axis of the mating recess, the resilient member positioned in a securing recess of the mating projection of the first connector assembly when the first connector assembly and the second connector assembly are mated;

wherein the second connector assembly can break away from the first connector assembly upon the application of a designated force, regardless of the direction the force is applied to the electrical connector assembly.

* * * * *